United States Patent [19]

Gibbs

[11] Patent Number: 4,653,403

[45] **Date of Patent: * Mar. 31, 1987**

[54] CARTRIDGE-LAUNCHED, DISK-DEPLOYED CHAFF

[76] Inventor: Robert L. Gibbs, 3773 Muirfield Dr., Uniontown, Ohio 44685

[ * ] Notice: The portion of the term of this patent subsequent to May 8, 2001 has been disclaimed.

[21] Appl. No.: 707,330

[22] Filed: Mar. 1, 1985

Related U.S. Application Data

[63] Continuation-in-part of Ser. No. 665,502, Oct. 29, 1984, which is a continuation of Ser. No. 451,014, Jan. 26, 1983, abandoned, which is a continuation-in-part of Ser. No. 334,597, Dec. 28, 1981, Pat. No. 4,446,793.

[51] Int. Cl.[4] ..... F42B 13/42; F42B 5/16

[52] U.S. Cl. ..... 102/436; 102/438; 102/504; 102/505; 89/1.51

[58] Field of Search ..... 102/505, 504, 436, 438; 89/1.5 R

[56] References Cited

U.S. PATENT DOCUMENTS 3,741,125 6/1974 LaPointe ..... 102/505

3,896,732 7/1975 Schaffer ..... 102/436

4,446,793 5/1984 Gibbs ..... 102/505

OTHER PUBLICATIONS

*Exploratory Development of Disc Deployed Chaff,* by MT Systems, Inc., Nov. 1981.

*Primary Examiner*—Deborah L. Kyle
*Assistant Examiner*—Michael J. Carone
*Attorney, Agent, or Firm*—L. A. Germain

[57] ABSTRACT

Apparatus for ejecting and dispersing a payload of passive radiation interference material into the near vicinity of a tactical aircraft comprises a cartridge case adapted for carrying and launching at least one cylindrical payload disk, the cartridge case having a lineal length of rack teeth within its bore and the payload disk having at least a portion of its exterior circumferential extent with matching gear teeth such that upon explosively pressurizing the cartridge case the payload disk is ejected exhibiting high linear and rotational velocities. The payload disk has tapered bore wall surfaces which confine the payload material and upon being ejected the spin-stabilized payload disk disperses the payload substantially uniformly within the first few milliseconds after leaving the cartridge case.

10 Claims, 7 Drawing Figures

FIG.-3
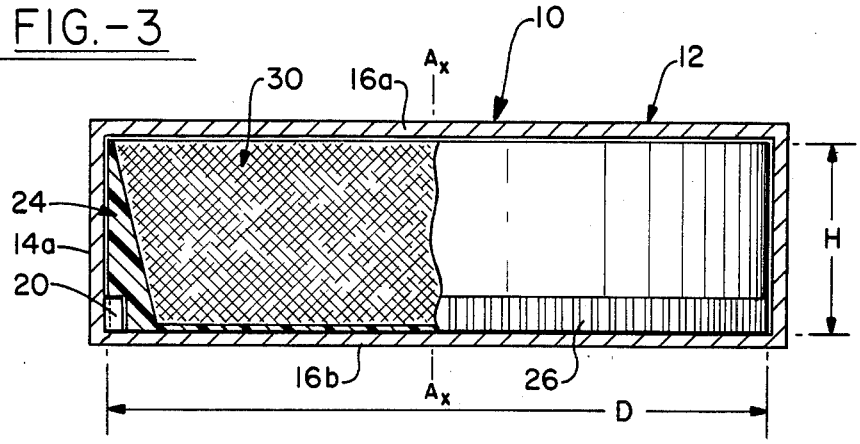
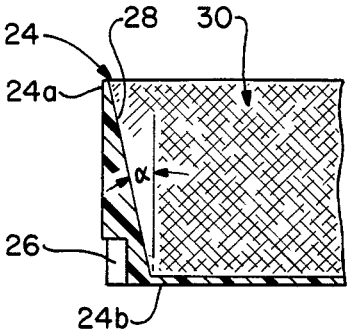
FIG.-4A
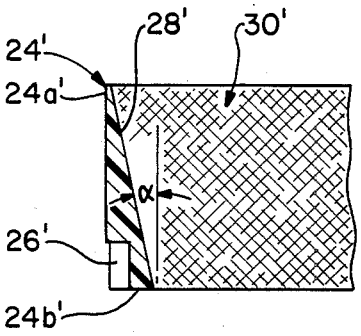
FIG.-4B
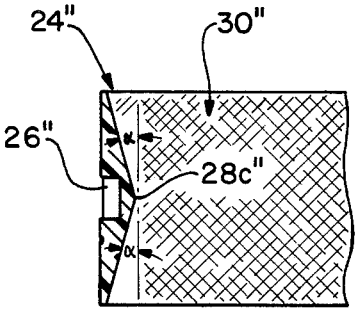
FIG.-4C

CARTRIDGE-LAUNCHED, DISK-DEPLOYED CHAFF

This is a continuation-in-part of prior application Ser. No. 665,502 filed Oct. 29, 1984 which is a continuation of application Ser. No. 451,014 filed Jan. 26, 1983 now abandoned, which is a continuation-in-part of application Ser. No. 334,597 filed Dec. 28, 1981 now U.S. Pat. No. 4,446,793 issued May 8, 1984.

BACKGROUND OF THE INVENTION

This invention generally relates to the field of passive electronic countermeasures and more specifically to apparatus for deploying expendable materials such as chaff from a tactical aircraft.

The use of chaff to defeat the radar function by denying it range and direction (azimuth and elevation) information is a well known and practiced technique in the art of radar jamming and/or countermeasures. Passive chaff elements in the form of discrete dipoles are dispensed by an aircraft to form a distinct cloud which creates a credible false target to the ground-based radar. The dipoles are generally low mass slivers of metalized milar, glass or other suitable dialectric material and these are compactly and densely packaged into canisters and loaded into ejection equipment aboard the aircraft. The ejection equipment fires the chaff out of the canisters into the aircraft windstream where velocity-induced turbulence or wind shear effects are available for cloud dispersion. The low mass chaff slivers, upon ejection, rapidly slow down and fall at an almost constant rate. For example, a widely used one-mil metalized glass chaff has a settling rate of about 50 feet per minute.

One of the problems with present chaff systems is that the low mass slivers are easily damaged by the high compressive force necessary to eject them from the canister and into the aircraft windstream. Being compressed, the chaff dipoles may not uniformly disperse in the windstream and therefor will not provide the desired radar countermeasures performance. In actual practice, approximately one third of a pound of various length chaff dipoles are placed into the aircraft boundary layer in approximately 6-to-8 milliseconds. Dipoles from the ejected clumps peel off layer-by-layer until all that remains is a saturated cloud of dipoles 1½–2 meters in width and height and 10–12 meters in length. Initial formation of the cloud takes approximately 200 milliseconds. At aircraft velocities on the order of 800 feet per second, cloud formation takes place well aft of the aircraft with a maximum cross section of approximately four square meters when viewed on a radial run.

From the foregoing, it can be appreciated that full chaff dispersion and/or cloud formation is desirable as soon as possible after the chaff are ejected from a loaded canister.

This invention provides an improved chaff ejection apparatus for deploying a quantity of dipoles, which apparatus imparts a vector to the chaff cloud that is transverse to the aircraft line-of-flight. This is accomplished by ejecting the chaff from a spin stabilized payload disk mounted in an ejection cartridge. As the payload disk is ejected from the cartridge, both high linear and rotational velocities are imparted to the disk and it emits the chaff dipoles in a substantially continuous manner as it moves out from the aircraft. When the spinning payload disk is ejected at an angle with respect to the aircraft line-of-flight (for example @ 90 degrees) and releasing chaff as it moves outwardly, a significant increase in cloud size is achieved while still in the vicinity of the launching aircraft. A particular advantage of the invention resides in the fact that the chaff dipoles are not compressively ejected from the aircraft, but rather, are packaged within an expendable disk. In this respect, the payload disk receives the force necessary for ejection leaving the chaff dipoles in their as-packaged condition. The self-protect ability of an aircraft is therefore enhanced by the rapid chaff cloud formation and its greater size when viewed by a ground-based radar.

BRIEF DESCRIPTION OF THE DRAWINGS

Various objects and advantages of the invention will become more apparent and fully understood and appreciated from a consideration of the following detailed description when taken in conjunction with the accompanying drawings in the several figures of which like reference numerals indicate like elements and in which:

FIG. 3 is an elevational view, in crosssection, of the apparatus shown in FIG. 1 as may be taken on line 3—3 of FIG. 2;

FIGS. 4A–4C are partial elevational views, in crosssection, of a payload disk illustrating various embodiments thereof.

DETAILED DESCRIPTION OF THE INVENTION

Figure 1:
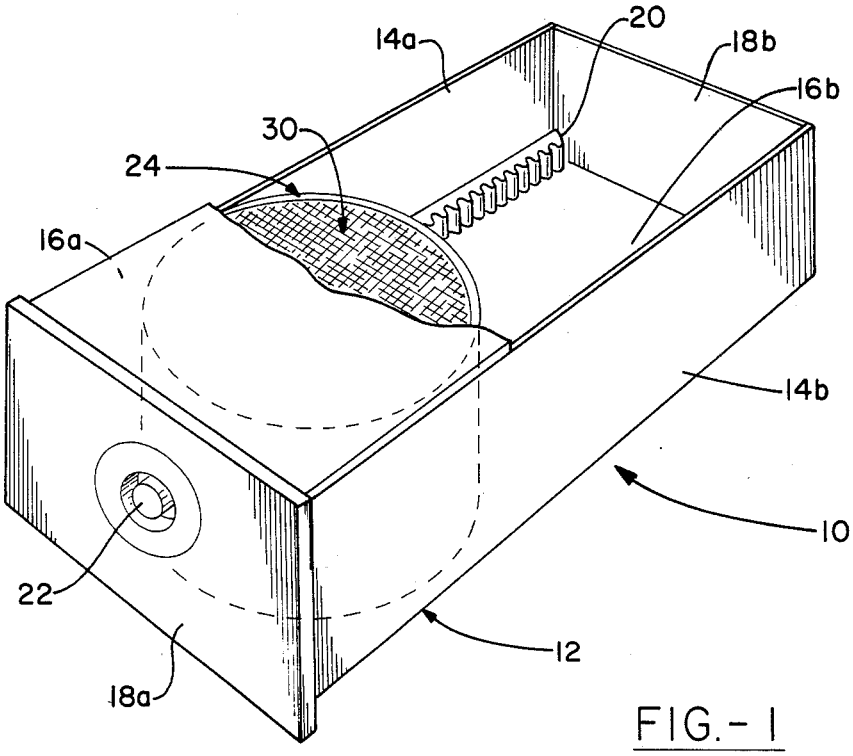
FIG. 1 is a perspective view, partially broken away, illustrating a chaff payload disk ejection cartridge forming a part of this invention.
Figure 2:
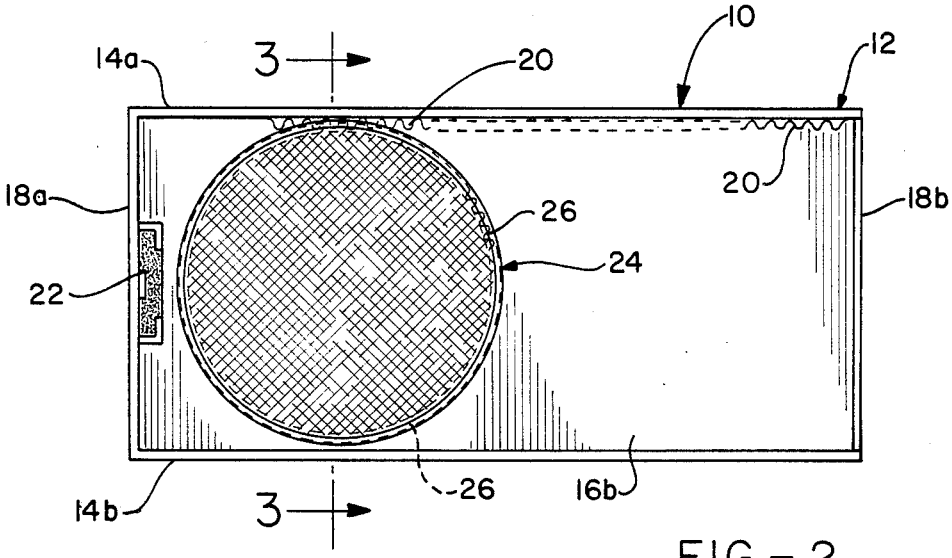
FIG. 2 is an exposed top plan view of the apparatus of FIG. 1.

Referring to FIGS. 1, 2 and 3 of the drawings, an apparatus for deploying passive chaff elements is generally indicated by reference numeral 10. The apparatus 10 occupies a volume space as established by presently used on-board aircraft chaff dispensing systems and therefore such apparatus 10 may be readily incorporated into such systems. The apparatus 10 comprises a rectangular cartridge case 12 having side walls **14*a* and 14*b*, top and bottom walls 16*a* and 16*b*, and end walls 18*a* and 18*b*. The walls of the cartridge case 12 may be made of plastic, lightweight metallic or other materials suitable for this type of application and at least one side wall 14*a* carries a toothed rack segment 20 which occupies a lineal length on its inside surface. One end wall 18*a* is characterized by an explosive impulse means 22, mounted in the wall, which is a conventional element in chaff deployment apparatus. The impulse means 22 is electrically connected to control circuitry (now shown) in the usual manner for ignition and detonation of the impulse means. The opposite end wall 18*b* is removable, that is, it may be easily discharged from the cartridge case 12** in the usual operation of the apparatus and this will be more fully described hereinafter.

At least one chaff payload disk generally indicated by reference numeral 24 is carried within the cartridge case 12. A payload disk 24 is substantially cylindrical in shape having a diameter "D" which is essentially but not necessarily exactly, the distance from one side wall **14*a* to the opposite side wall 14*b*** and has a height "H"

which is essentially the inside distance from the top 16*a* to the bottom 16*b* as clearly evident in FIG. 3 of the drawing. Further, a payload disk 24 is characterized by a plurality of gear-like teeth 26 formed about at least a portion of its circumferential extent. The teeth 26 are adapted for engagement with the teeth of the rack segment 20 such as to impart a rotation to the payload disk 24, about its axis Ax , as it moves lengthwise from one end 18*a* of the cartridge case to the opposite end 18*b*.

Referring now to FIGS. 4A, 4B, and 4C of the drawings, various configurations for a payload disk 24 are illustrated. In FIG. 4A, a partial cross-section is shown, the payload disk having a top end indicated at 24*a* and a bottom end indicated at 24*b*. The cylindrical shape of the disk 24 defines a bore 28, which bore is characterized by a diameter at the top end 24*a* that is greater than the diameter at the bottom end 24*b*. The bore walls are therefore tapered outwardly from the bottom of the disk and define an angle $\alpha$ taken with respect to the cylinder axis $A_x$. The payload disk 24 shown in FIG. 4A has a closed end at the bottom 24*b* and a plurality of chaff dipoles generally indicated at 30 are packaged and/or carried within the disk bore 28. A plurality of gear-like teeth 26 are formed in at least a portion of the outer circumferential extent of the disk 24 and preferably in the thicker portion of the cylinder wall at the bottom end 24*b*. Accordingly, the rack segment 20 is formed in the cartridge case wall 14*a* along a lineal length at the bottom thereof such as to engage the teeth 26 when the payload disk 24 is loaded into the case 12.

FIG. 4B illustrates a similar payload disk 24', but according to this embodiment the bottom end 24*b'* is not closed. The payload disk 24' is therefore an open cylinder and containment of the chaff 30' within the bore 28' is accomplished by the fact that the cartridge case top and bottom walls 16*a*, 16*b* are spaced apart a distance substantially the height "H" of the payload disk 24'. The plurality of gear-like teeth 26' are also formed at the bottom end 24*b'* of the disk 24'.

FIG. 4C illustrates an alternative embodiment wherein a payload disk 24'' has a bore 28'' having tapered wall surfaces which extend from a larger diameter at both of the top and bottom ends 24*a''* and 24*b''* respectively, terminating in a smaller diameter at the center of the disk bore at 28*c''*. According to this embodiment, the teeth 26'' are located about the centerline of the disk 24'' and therefore the rack segment 20 must be located along a lineal length at the mid-point of the cartridge case wall 14*a*.

Figure 5:
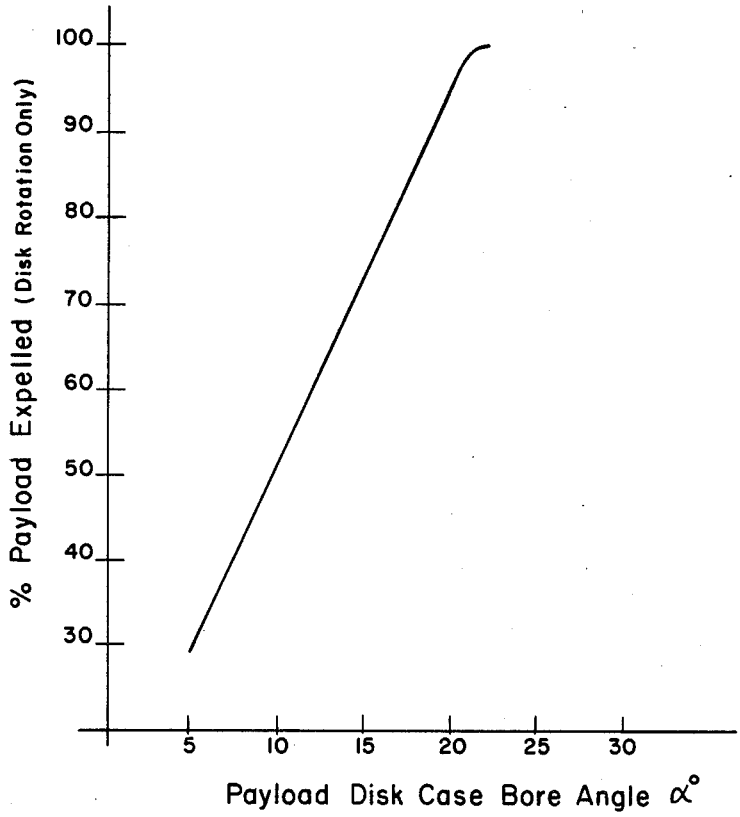
FIG. 5 is a graph illustrating the percentage of chaff dipoles expelled from a payload disk as a function of the wall angle of the disk bore into which the chaff are packaged.

While it is recognized that the position and location of the gear teeth 26 and rack segment 20 may be varied along the height "H", the taper of the walls of the bore 28 is optimized at a particular angle $\alpha$. FIG. 5 illustrates the relationship of the percentage chaff payload which may be expelled from a payload disk 24 as a function of the bore wall angle $\alpha$. The graph of FIG. 5 was generated by mounting payload disks 24 having various bore angles $\alpha$ in a test fixture. The test fixture spun each disk 24 to 1725 rpm within a few milliseconds. Because only rotational velocity and no linear velocity was imparted to the payload disks, the angle $\alpha$ will be lower than the optimum of about 15 degrees as indicated in the figure. It is considered that the addition of a linear velocity and the effects of windshear experienced at the boundary layer of a tactical aircraft, that the angle $\alpha$ must be at least 5 degrees with respect to the disk bore axis.

In operation, a cartridge case 12 is loaded into a dispenser block which is not part of this invention, but suffice to say that such block carries and retains a plurality of cartridge cases 12, provides a firing pulse as appropriate to the impulse explosive means 22, and provides the necessary physical restraint against expansion of the cartridge case when the impulse means 22 is detonated. Upon detonation of the impulse means 22, the pressure within the cartridge case between the end wall 18*a* and the payload disk 24 increases by several hundred pounds per square inch in a substantially instantaneous manner. This pressure accelerates the disk 24 towards the opposite end 18*b*, while simultaneously, the engaged rack and gear teeth 20, 26 impart a rotational acceleration to the disk 24. The removable wall 18*b* is discharged from the cartridge case by, either the build-up of internal pressure within the case or by the payload disk as it exits the case. The payload disk 24 clears the exit plane of the cartridge case 12 within a few milliseconds exhibiting relatively high linear and rotational velocities. In this circumstance, chaff dipoles carried within the payload disk bore 28 begin dispersing by reason of the spinning action of the disk, the absence of any member to contain the chaff within the disk bore 28, and the wind shear effect present along the boundary layer of the aircraft. The tapered wall surfaces of the disk bore 28 further enhances the ability of the chaff to be dispersed and insures that a high percentage of the chaff is expelled from the payload disk case.

From the foregoing, it must be appreciated that, because the payload disk 24 is spin stabilized by its loaded relationship within the cartridge case 12, the chaff dipoles are released at various distances outboard of the aircraft flight axis. The result of this is that a chaff cloud is formed almost instantaneously, i.e., in the near vicinity of the launching aircraft. In fact, a chaff cloud exhibiting a greater radar cross-section response is formed during the first critical few milliseconds than herebefore accomplished by the prior art. Of course, payload deployment may be further optimized by varying the density and mass of the payload disk 24 and/or varying the packaging density of the chaff dipoles 30.

What is claimed is:

1. Apparatus for ejecting a payload of radiation interference material from an aircraft and distributing elements comprising the payload into the atmosphere in the near vicinity of the aircraft comprising in combination:

a cartridge case having a length greater than its width and top, bottom, and side walls defining a rectangular bore throughout its length and having impulse means at one end to explosively pressurize the interior of the case when ignited, said bore having rack tooth means positioned along a lineal length of one of its side walls;

at least one payload disk carried within the cartridge case bore and movable longitudinally therein, said payload disk comprising a cylindrically shaped disk case having an axis of rotation perpendicular to the top and bottom walls of the cartridge case and defining a bore having tapered wall surfaces the angle of which is taken with respect to the disk case axis, said disk case having at least a portion of its exterior circumferential extent formed to a plurality of gear-like teeth which match and which mate with the rack tooth means; and a payload of radiation interference material carried within the bore of the payload disk case;

said payload disk being explosively expelled from the cartridge case upon ignition of the impulse means and exhibiting relatively high linear and rotational velocities such that upon exiting the cartridge case the elements comprising the payload of radiation interference material are substantially uniformly dispersed from the disk case.

2. Apparatus as set forth in claim 1 wherein the angle of the disk case bore surfaces is at least 5 degrees with respect to the disk case axis.

3. Apparatus as set forth in claim 1 wherein the cylindrically shaped disk case has a closed end and the disk case bore has a diameter at the open end that is greater than the diameter at the closed end to form an angle of at least 5 degrees with respect to the bore axis and the plurality of gear-like teeth are formed in the exterior circumferential extent about the closed end of the disk case; and the rack tooth means are positioned along a lineal length at the bottom of one side wall so as to operatively engage the teeth formed on the disk case.

4. Apparatus as set forth in claim 1 wherein the cylindrically shaped disk case is open at both ends and the disk case bore has a diameter at one end is greater than the diameter at the opposite end to form an angle of at least 5 degrees with respect to the bore axis and the plurality of gear-like teeth are formed in the exterior circumferential extent about the end of the disk case having the smaller bore diameter; and the rack tooth means are positioned along a lineal length at the bottom of one side wall so as to operatively engage the teeth formed on the disk case.

5. Apparatus as set forth in claim 1 wherein the cylindrically shaped disk case is open at both ends and the disk case bore has a diameter at each of said ends which is greater than the diameter at the mid-point of the bore to form angles of at least 5 degrees with respect to the bore axis and the plurality of gear-like teeth are formed in the exterior circumferential extent about the mid-point of the disk case; and the rack tooth means are positioned along a lineal length at the mid-point of the side wall so as to operatively engage the teeth formed on the disk case.

6. Apparatus for ejecting and dispersing a payload of chaff elements into the near vicinity of a tactical aircraft comprising in combination:

a cartridge case having a plurality of walls defining a rectangular bore throughout its length, one end of the case having impulse means to explosively pressurize the bore when ignited and at least one of said walls carrying a lineal length of rack tooth means longitudinally within the bore; and at least one payload disk carried within the cartridge case bore, movable longitudinally within the bore and comprising a cylindrical disk case having an axis of rotation perpendicular to the longitudinal extent of the cartridge case, said cylindrical disk case defining a bore having tapered wall surfaces and at least a portion of its exterior circumferential extent has gear-like teeth formed in its outer surface which operatively engage the rack tooth means in the cartridge case bore; and a payload of chaff elements carried within the payload disk case bore;

said payload disk being explosively expelled from the cartridge case upon ignition of the impulse means and exhibiting high linear and rotational velocities such that upon exiting the cartridge case the chaff elements are dispersed from the disk case.

7. Apparatus as set forth in claim 6 wherein the tapered wall surfaces of the disk case bore are angled at least 5 degrees with respect to the axis of rotation of the disk.

8. Apparatus as set forth in claim 6 wherein the tapered wall surfaces of the disk case bore are angled outwardly from a midpoint within the bore at an angle of at least 5 degrees with respect to the axis of rotation of the disk.

9. Apparatus as set forth in claim 7 wherein the disk case has a closed end and the diameter of the bore at the open end is greater than the diameter at the closed end and the gear-like teeth are positioned about the closed end on the outer surface of the disk case.

10. Apparatus as set forth in claim 8 wherein the ends of the disk case are open and the gear-like teeth are positioned about the midpoint on the outer surface of the disk case.

* * * * *